United States Patent [19]

Wolf et al.

[11] 4,372,816

[45] Feb. 8, 1983

[54] HEAD BOX FOR A PAPER MAKING MACHINE

[75] Inventors: Jakob Wolf, Heidenheim; Simon Juhas, Nattheim, both of Fed. Rep. of Germany

[73] Assignee: J. M. Voith GmbH, Fed. Rep. of Germany

[21] Appl. No.: 242,724

[22] Filed: Mar. 12, 1981

[30] Foreign Application Priority Data

Mar. 20, 1980 [DE] Fed. Rep. of Germany ..... 3010730

[51] Int. Cl.[3] ..... D21F 1/06

[52] U.S. Cl. ..... 162/343; 162/336

[58] Field of Search ..... 162/301, 336, 327, 343

[56] References Cited

U.S. PATENT DOCUMENTS

| | | | |
|---|---|---|---|
| 2,037,243 | 4/1936 | Kutter | 162/343 |
| 2,127,698 | 8/1938 | Niks | 162/327 |
| 2,749,815 | 6/1956 | Steward | 162/338 |
| 3,649,448 | 3/1972 | Kobayashi | 162/343 |
| 4,181,568 | 1/1980 | Pfaler | 162/343 |

FOREIGN PATENT DOCUMENTS

| | | | |
|---|---|---|---|
| 701581 | 12/1953 | United Kingdom . | |
| 1236461 | 6/1971 | United Kingdom | 162/343 |

*Primary Examiner*—Peter Chin

*Attorney, Agent, or Firm*—Ostrolenk, Faber, Gerb & Soffen

[57] ABSTRACT

The disclosure concerns the chamber of a head box for a paper making machine. Movable partition walls extend between the side walls of the chamber. Opposed stub shafts in the opposite side walls of the chamber carry eccentric journal pins which are received in respective partition walls, such that rotation of each stub shaft adjusts the position of the respective engaged partition wall. A second concentric pin on each stub shaft also engages the respective partition wall, whereby the eccentric pin may move the partition wall while the concentric pin may guide the movement. Appropriate longitudinally extending grooves are defined in the partition wall to absorb the motion caused by rotation of the stub shaft, which moves the partition wall with respect to the stub shaft. As appropriate, there may be respective generally mutually perpendicular longitudinally extending grooves for the concentric and eccentric pins, respectively.

14 Claims, 6 Drawing Figures

HEAD BOX FOR A PAPER MAKING MACHINE

BACKGROUND OF THE INVENTION

The present invention relates to a head box or flow box for a paper making machine. A fibrous suspension of pulp is sprayed from the head box onto a wire screen web, called a wire. The head box includes a chamber having an outlet duct. Partition walls are arranged in the outlet duct and are supported on the side walls of the head box chamber. The partition walls extend generally in the direction of flow of the suspension.

The head box or flow box in British Pat. No. 1,457,667 has a partition wall that is located in the stream of suspension. That wall is rigidly fastened to a horizontal cross member between the opposed vertical side walls of the flow box chamber. It is desirable to obtain a flow of the suspension which is as homogeneous and uniform as possible over the entire width of the head box as well as within the width of the slot at the flow outlet (layer thickness). For this purpose, it may be necessary to shift the supported positions of the partition walls in certain directions and within certain limits. The partition walls must be movable either transverse to the direction of flow to change the width of the outlet duct or along the direction of flow in order to change the flow conditions at the pulp outlet, or in a combination of both directions.

SUMMARY OF THE INVENTION

The object of the invention is to support these partition walls to permit the positions of the partition walls to be changed, both transversely to and along the direction of flow. It is necessary that neither the side walls of the box chamber nor the bottom or top of the head box chamber be interrupted by actuating members as such members passing through the chamber walls leads to sealing problems. It is additionally necessary that there be no points at which the flow of the suspension is disturbed and on which particles of pulp can deposit with detrimental effect.

According to the invention, the head box or flow box of a paper making machine includes a chamber from which the pulp suspension flows on to an appropriate web, which is in the form of a wire screen, known in the industry as a wire. At the outlet from the head box chamber, a plurality of partition walls are provided, as is conventional for directing the outflow of suspension to the wire. The position of each partition wall either longitudinally of their own length, that is along the flow direction of the suspension, or transverse to the flow direction of the suspension, is adjusted through the use of a rotatable shaft which is eccentrically connected to the partition wall, for example by a pin extending from the shaft to the partition wall, such that rotation of the stub shaft in the side wall of the chamber will accordingly move the partition wall to a new position. A concentric connection between the shaft and the partition wall, e.g. from a concentric pin on the shaft, may also be provided, so as to guide the motion of the partition wall under the influence of the rotation of the shaft and the corresponding movement of the eccentric pin.

By appropriately oriented grooves in the partition wall for cooperating with one or both of the eccentric and concentric pins on the rotatable shaft, the desired movement of the partition wall can be obtained. In various embodiments, one longitudinally extending groove is provided either for the eccentric pin or for the concentric pin or for both, and appropriate motion of the partition wall follows upon rotation of the stub shaft.

Other objects and features of the invention can be noted from the following description and accompanying drawings.

DESCRIPTION OF PREFERRED EMBODIMENTS

Figure 1:
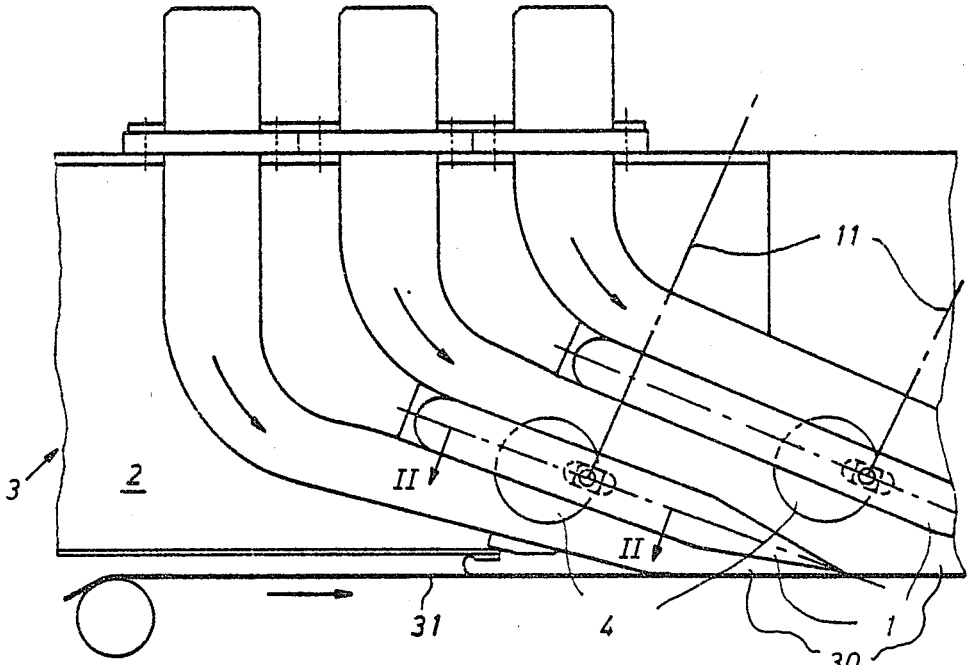
FIG. 1 schematically shows a head box chamber with displaceable partition walls.

In the head box embodiment shown in FIG. 1, there is a head box chamber 3 which is defined between opposed, spaced apart, parallel side walls 2. Partition walls 1 extend across the space between the side walls and are supported there so that they are perpendicular to the side walls. The partition walls are adjustable in position, as described below.

A partition wall may be a plate of suitable thickness, which is flat or favorably arched for the flow, or may be a relatively thin membrane which can be suitably stiffened merely in order to obtain the required flexural strength. The illustrated partition walls 1 are relatively thick beams, which are not adapted to flex. They are thick enough to cooperate with the below described pins 6, 12, 20 and 22. Each partition wall 1 is rigidly supported at one end in the chamber 3, but is supported for turning through below described means provided in the side wall 2 of the head box chamber 3. The direction of flow of the suspension is towards the tapered narrowed end of the partition walls. The displacement device for changing the position of the partition walls is located in the vicinity of the tapered ends of the partition walls. The head box chamber has an outlet 30 to which the liquid pulp suspension is delivered and from which the pulp is applied in known manner to a wire screen web 31 which moves continuously past the outlet 30.

Figure 2:
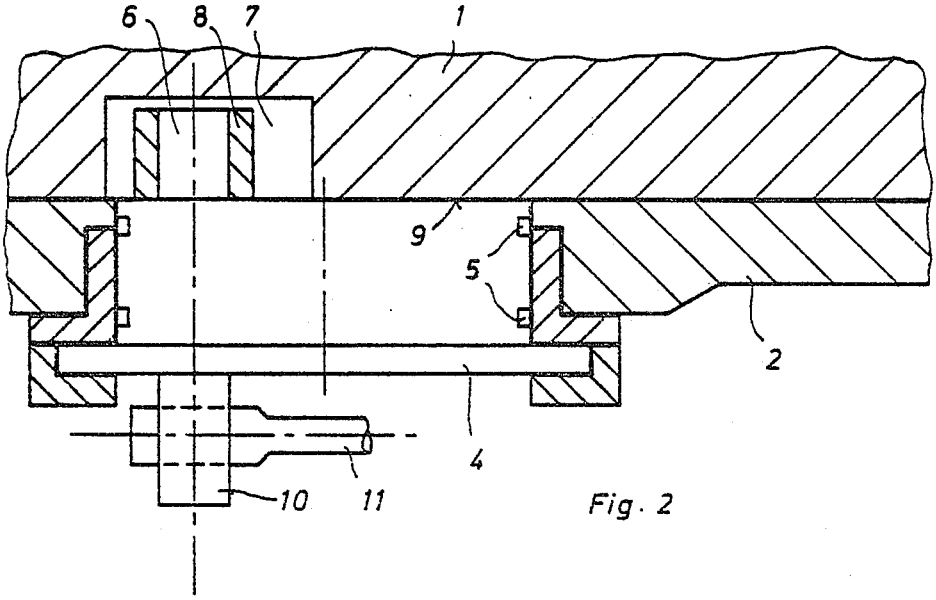
FIG. 2 is a fragmentary cross-sectional view along line II—II of FIG. 1 showing one embodiment of a displacement device for the partition walls.

To move the partition walls acting from outside to inside the flow box chamber, a respective circular stub shaft 4 is provided, as shown in FIG. 2, for connection to each partition wall 1. A pair of opposed stub shafts are provided within opposed, aligned openings provided in both side walls 2 of the head box chamber 3. The end of each stub shaft toward the inside of the head box chamber 3 is flush with the inner surface of the respective side wall 2. The side wall 2 also includes the seal 5 around the stub shaft.

On the end of the stub shaft facing the inside of the head box, there is an eccentrically arranged journal pin 6, which is received in an opening 7 in the partition wall 1. Between the journal pin 6 and the surfaces forming the opening 7 there is a slide block or a roller 8 for reducing friction.

Upon rotation of the stub shaft 4, the eccentric journal pin 6 carries the partition wall 1 with it and thereby changes its position. This has the advantage that a longitudinal, transverse movement of the partition wall is brought about from the outside by a turning motion. The actuating member for this is the circular stub shaft 4.

The sealing problem extends to sealing a rotating shaft in a circular wall opening, which can be technically controlled. A slot in the wall of the head box or an oscillating actuating device would, on the other hand, result in extreme expense for sealing. Furthermore, with the arrangement in accordance with the invention, the inner surface 9 of the head box chamber remains precisely smooth.

The stub shaft can be rotated from the outside by a journal pin 10, which is also eccentric, using a longitudinally movable spindle 11 or crank, or by applying a torque by means of a servomotor.

In a further embodiment, the partition wall, as shown in FIG. 1, may be mounted in the above described displacement device both at the tapered end and at the end facing the head box and thus the wall can be shifted and tilted as desired. In each case, one of the openings 7 which serve for the guidance would have to be developed as a circular borehole or as a longitudinal groove, as detailed below.

In yet another embodiment, the displacement device for the partition wall incudes a precise guide in the longitudinal or transverse directions. With purely longitudinal displacement, the slot at the suspension outlet can be varied without changing the channel width, while with purely transverse displacement (meaning vertical displacement), the channel width of two adjacent feed channels can be varied.

Figure 3:
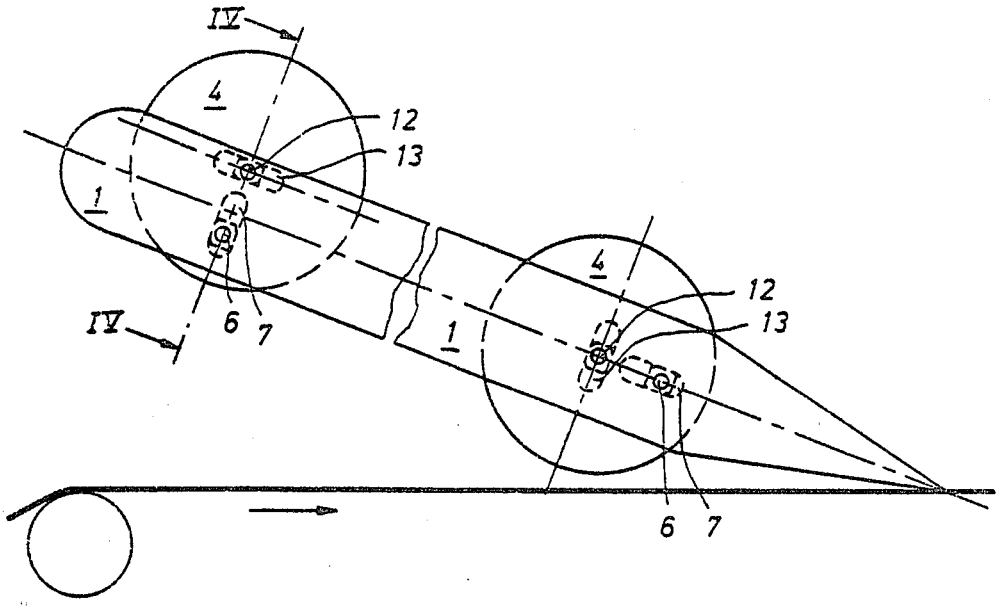
FIG. 3 schematically shows a second embodiment of a displacement device.

In the embodiment of FIG. 3, the stub shaft 4 is provided both with the above described eccentric journal pin 6 and also with a concentric guide pin 12. These two pins engage in respective longitudinal grooves 7 and 13, and the respective longitudinal axes of these grooves intersect. At the end of the partition wall facing into the head box, i.e. at the left in FIG. 3, the concentric guide pin 12 extends into a longitudinal groove in the partition wall which lies along the longitudinal direction of the partition wall. The eccentric journal pin 6 extends into the longitudinal groove 7 which is perpendicular to the longitudinal groove 13. Upon rotation of the stub shaft 4, the journal pin 6 transmits the movement to the partition wall which slides along the longitudinal groove 13 on the guide pin 12. The maximum path of displacement is determined by the respective lengths of the grooves 7 and 13.

On the tapered end of the partition wall 1 in FIG. 3, there is an embodiment of a displacement device in which the concentrically arranged guide pin 12 engages in a groove which extends transverse to the longitudinal direction of the partition wall. The eccentric journal pin 6 extends into the longitudinal groove 7 which is arranged in the longitudinal direction of the partition wall 1. Upon turning of this stub shaft 4, the partition wall moves transversely to the flow of pulp. Each partition wall however carries only one kind of the displacement devices shown paired in FIG. 3 for explanatory purposes.

Figure 4:
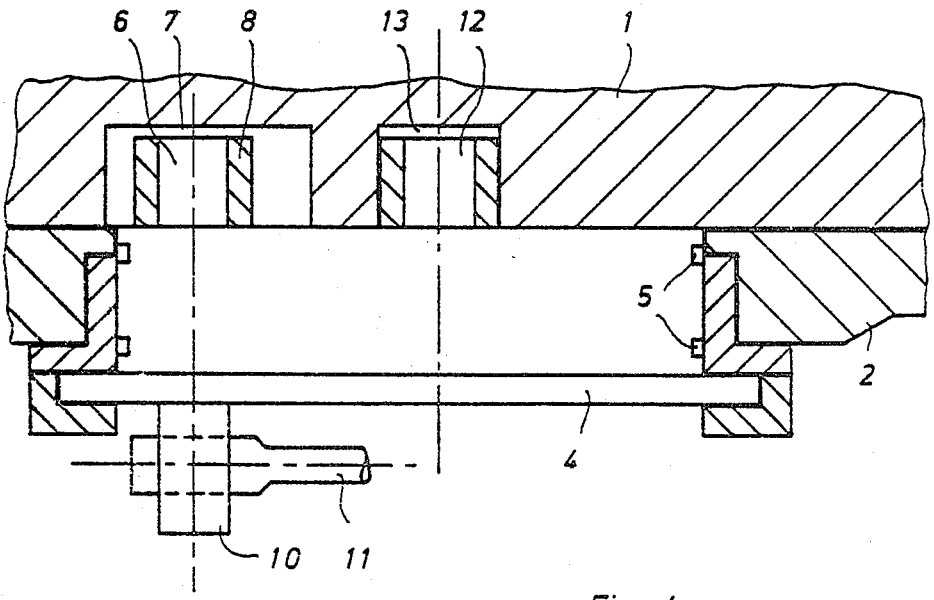
FIG. 4 is a fragmentary cross-sectional view along the line IV—IV of FIG. 3 through the second embodiment of the displacement device.

In FIG. 4, the displacement device includes a guide pin 12 and a journal pin 6.

Figure 5:
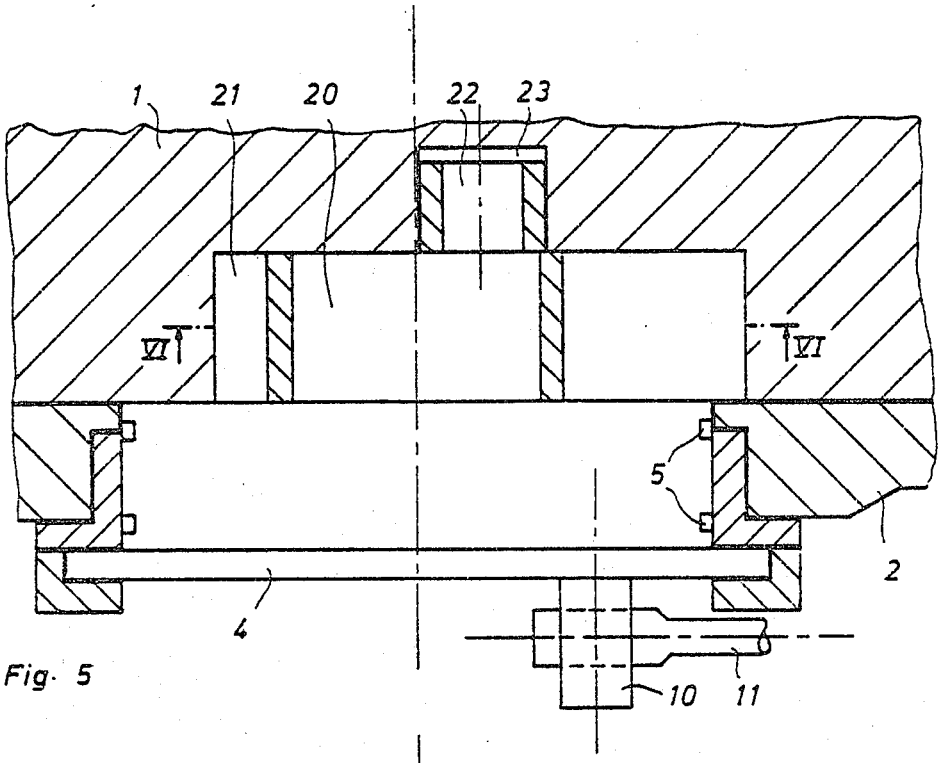
FIG. 5 is a fragmentary cross-sectional view through another embodiment of a displacement device, along the line V—V of FIG. 6.
Figure 6:
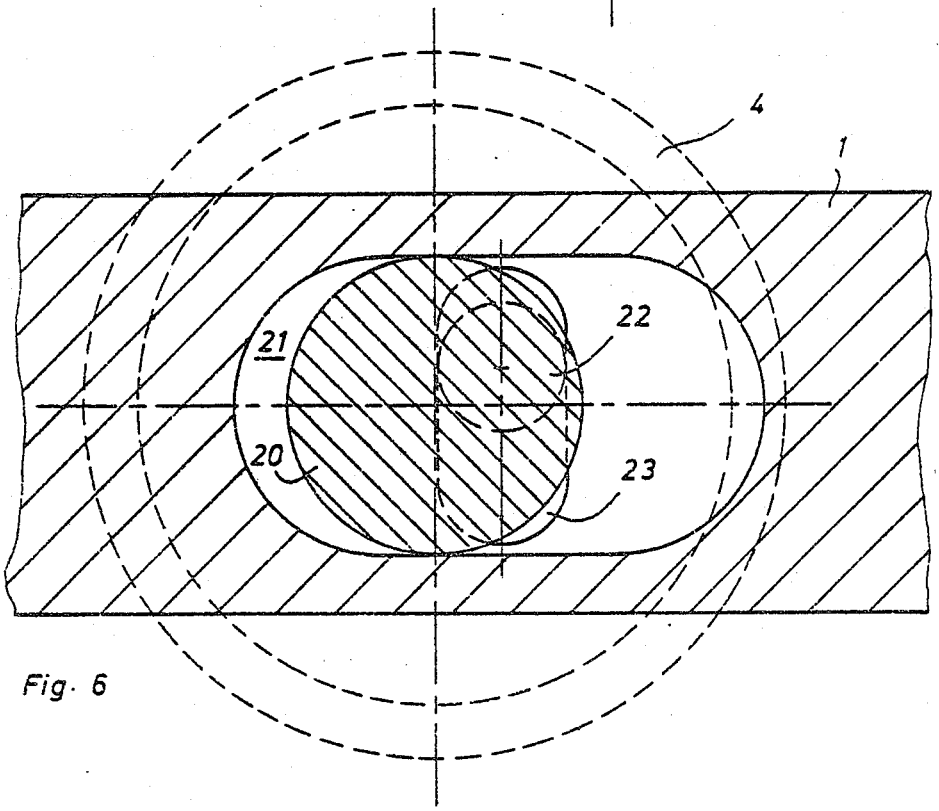
FIG. 6 shows the arrangement of pin and grooves for the embodiment of FIG. 5.

The displacement device shown in FIGS. 3 and 4 provides precise longitudinal or transverse guidance. A variant of that device is shown in FIGS. 5 and 6. Here the stub shaft 4 does not carry two separate pins which together guide and displace the partition wall 1. Instead, the stub shaft 4 carries a concentric guide pin 20, which in turn carries the eccentric journal pin 22 at its inner end. The diameter of the guide pin 20 is large enough that the cross-sectional surface of the journal pin 22 lies at least in part within the cross-sectional surface of the guide pin 20. The grooves 21 and 23 associated with the guide and journal pins 20, 22, respectively, are at different depths within the partition wall 1. The longitudinal grooves 21 and 23 have intersecting longitudinal axes which are arranged in accordance with the requirements that longitudinal or transverse displacement of the partition wall 1 is brought about. Upon one complete revolution of the stub shaft 4, the partition wall moves over the full displacement path and back again, corresponding to the established direction of the longitudinal groove 21.

The advantage of the latter embodiment is that the space required for its arrangement in a partition wall is less, particularly if the guide pin must have a large diameter and the displacement path is to be small.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. In head box for a paper making machine, the head box having a head box chamber and the chamber being defined between opposed side walls of the head box; a circular opening in one said side wall; the chamber including an outlet channel;

at least one partition wall supported in the outlet channel of the chamber between the side walls;

and adjusting means for adjusting the initial position of the at least one partition wall in the outlet channel; the adjusting means comprising a circular shaft supported in a water-tight manner in the circular opening formed in the one side wall of the chamber and being rotatable about its axis with respect to the side walls;

the shaft having a side facing inwardly of the chamber; a journal pin being supported on the side of the shaft facing inwardly of the chamber and being eccentric with respect thereto; means in the partition wall for receiving the journal pin for adjusting the initial position of the partition wall as the shaft is rotated.

2. The head box of claim 1, wherein there is one of the shafts at each of the opposed side walls of the chamber, whereby the shafts are paired, and the shafts of each pair have respective inwardly facing sides that are opposed.

3. The head box of claim 1, wherein the shaft is positioned such that the inwardly facing side thereof is flush with the respective opposed side wall.

4. The head box of any of claims 1 or 3, wherein the one partition wall includes a longitudinally extending groove therein in which the journal pin is engageable, the groove extending in one direction whereby upon rotation of the shaft, the journal pin shifts along the groove while the journal pin also moves the partition wall transversely to the direction of extension of the groove.

5. The head box of claim 4, wherein the journal pin includes a slide block thereon for facilitating sliding of the journal pin along the groove.

6. The head box of claim 4, further comprising an additional concentric journal pin also supported at the inwardly facing side of the shaft, and the one partition wall including means for being engaged by the concentric journal pin.

7. The head box of claim 6, wherein the means for being engaged by the concentric journal pin comprises a second longitudinally extending groove in the partition wall in which the concentric pin is received, whereby when the partition wall is moved by the eccentric pin, such movement is guided by the engagement of the concentric pin with the second groove.

8. The head box of claim 7, wherein the second groove extends along a direction generally perpendicular to the direction of extension of the first mentioned groove.

9. The head box of claim 1, further comprising an additional concentric journal pin also supported at the inwardly facing side of the shaft, and the one partition wall including means for being engaged by the concentric journal pin.

10. The head box of claim 9, wherein the means for being engaged by the concentric journal pin comprises a longitudinally extending groove in the partition wall in which the concentric pin is received, whereby when the partition wall is moved by the eccentric pin, such movement is guided by the engagement of the concentric pin with the groove.

11. The head box of claim 9, further comprising at least one longitudinally extending groove being defined in the partition wall, and one of the eccentric pin and the journal pin being engaged in the groove, the other of the eccentric pin and the journal pin also being engaged by the partition wall, whereby as the other of the pins moves the partition wall, such movement is guided by the engagement of the one of the pins in the longitudinal groove.

12. The head box of claim 9, wherein the concentric pin has an inwardly facing side facing inwardly of the chamber, and the eccentric pin is supported on the inwardly facing side of the concentric pin; the concentric pin is of sufficient diameter for at least in part overlapping the eccentric pin.

13. The head box of claim 12, wherein the means for being engaged by the concentric pin comprise a longitudinally extending groove in the partition wall, an additional longitudinally extending groove which intersects the first mentioned groove is also being provided in the partition wall; the additional groove being for receiving the eccentric pin; and the two longitudinally extending grooves intersecting within the cross-sectional surface of the concentric pin.

14. The head box of claim 13, wherein the grooves are of different respective depths into the partition wall, with the additional longitudinally extending groove being deeper toward the inside of the chamber than the first mentioned longitudinally extending groove.

* * * * *